US007460927B1

(12) United States Patent
Lai

(10) Patent No.: US 7,460,927 B1
(45) Date of Patent: Dec. 2, 2008

(54) METHOD OF MANUFACTURING KNITTED FABRICS

(75) Inventor: Henry Lai, Hsin Tien (TW)

(73) Assignee: Freeman Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/003,257

(22) Filed: Dec. 21, 2007

(51) Int. Cl.
*G06F 19/00* (2006.01)

(52) U.S. Cl. ..... 700/141; 66/232

(58) Field of Classification Search ..... 700/130, 700/131, 132, 141; 66/231, 232, 64
See application file for complete search history.

(56) References Cited

U.S. PATENT DOCUMENTS 3,693,168 A * 9/1972 Halkyard et al. ..... 700/133
3,863,260 A * 1/1975 Glaunsinger et al. ..... 66/1 R
3,893,166 A * 7/1975 Pugsley ..... 358/523
3,924,244 A * 12/1975 Seitz ..... 700/131
4,078,253 A * 3/1978 Kajiura et al. ..... 700/131
4,346,366 A * 8/1982 Kajiura et al. ..... 700/141
5,058,174 A * 10/1991 Carroll ..... 700/131
5,557,527 A * 9/1996 Kotaki et al. ..... 700/131
5,812,110 A * 9/1998 Kawasaki et al. ..... 700/141
5,966,454 A * 10/1999 Thomas et al. ..... 700/131
5,983,952 A * 11/1999 Carpenter et al. ..... 139/1 R
6,082,412 A * 7/2000 Wildeman et al. ..... 139/383 R
6,611,730 B1 * 8/2003 Stoll et al. ..... 700/131
6,845,284 B2 * 1/2005 Bingham et al. ..... 700/141
6,880,367 B2 * 4/2005 Suzuki ..... 700/141
7,127,321 B2 * 10/2006 Kenji et al. ..... 700/141
7,272,244 B2 * 9/2007 Saporiti et al. ..... 700/131
2004/0027623 A1 * 2/2004 Saporiti et al. ..... 358/527

* cited by examiner

*Primary Examiner*—Danny Worrell
(74) *Attorney, Agent, or Firm*—Rosenberg, Klein & Lee

(57) ABSTRACT

The present invention discloses a method of manufacturing knitted fabrics, more particularly a method of skillfully transferring a painting artwork onto a knitted fabrics to show the artistic verve of the painting. The manufacturing method includes the steps of: inputting an original drawing into a computer for digitization; editing and designing the digitized original drawing on a knitted fabric; outputting a knitting square plot after a graphic software performs a color processing; introducing graphic file information analyzed and processed by a knitting software to a knitting machine; and operators following a lamp signal of the knitting machine and the knitting square plot to knit to shape a knit piece, so as to complete a fashioned fine-art knitted fabric.

1 Claim, 5 Drawing Sheets

METHOD OF MANUFACTURING KNITTED FABRICS

BACKGROUND OF THE INVENTION

1. Field of the Invention

The present invention relates to a method of manufacturing knitted fabrics, and more particularly to a method of skillfully transferring a painting artwork onto a knitted fabrics to show the artistic verve of the painting, and the manufacturing method primarily includes the steps of: inputting an original drawing into a computer for performing an image digitization process; decomposing the digitized original drawing, and editing and designing the digitized original drawing onto a knitting fabric; performing a color processing of the new design drawing file by a graphic software; transferring the processed graphic file into a knitting software, and outputting a knitting square plot after being analyzed and processed by the knitting software; introducing the graphic file information analyzed and processed by the knitting software to a knitting machine; and knitting to shape a knit piece according to a manufacture process performed by the knitting machine, wherein the graphic file information introduced by the knitting software is indicated by a lamp signal, and a knitting square plot is outputted, so as to complete a fashioned fine-art knitted fabric.

2. Description of the Related Art

In general, a traditional method of manufacturing knitted fabrics as shown in FIG. 1 usually includes the following steps. A designer prepares a design drawing (11) which may be a fashion design or pattern for making clothes as an example, and the design drawing (11) contains a selection of color yarns and an arrangement of warp knitting and weft knitting, and a pattern making procedure (12) is performed. Operators follow the pattern making (12) to complete a knitting to shape process (13). The aforementioned traditional manufacturing method still has the following shortcomings:

1. The preparation of performing the pattern making process (12) from the design drawing (11) manually is very complicated and time-consuming.
2. Since the threading head of the hook disposed on the structure occupies a specific space and position, a full automation cannot be used for exchanging different colors of two adjacent yarns, but the formation of the pattern of a knitted fabric is achieved by changing the colors of the yarn. As a result, the traditional knitted fabric can be produced with simple regular lines or geometric shapes, but it will involve a high level of difficulty to produce complicated irregular shapes such as a curve or an arc.
3. If the pattern of the knitted fabric is a totem such as a dragon, a cloud, a mountain, a river, a bird, or a beast, the complicated gorgeous pattern and the colorful design results in a thick, heavy, hard, rigid, and inelastic knitted fabric. Although the knitted fabric may look gracious, yet it is not ergonomic or comfortable.

In view of the foregoing shortcomings, the inventor of the present invention based on years of experience to conduct extensive experiments and modifications, and finally invented a method of manufacturing knitted fabrics in accordance with the present invention.

SUMMARY OF THE INVENTION

Art creation shows human being's wisdom of expressing the existence of universe and life, and painting artwork has been a long time glory lightening up the history. Regardless of social status, time or place, everyone can appreciate the art and its vitality surpasses the boundary of nations, and such artwork always causes spiritual shock and resonance, and also surpasses all kinds of pains and tension, so as to enhance the life quality of human beings.

Entering into the low-profit era, people are competing in an environment with a low add-on value and a quick manufacture, our world is unconsciously occupied by material civilization, and our living environment becomes boring, and our heart becomes empty. Now, art creations and artworks are like a timely rainfall in a dessert which is a long desired need of human beings The method of manufacturing knitted fabrics in accordance with the present invention not only inherit the essence of the Oriental art, but also accept the ideas and creation techniques of Western's modern art, and it can be called an integration of Oriental and Western arts.

With expectations from different areas, the invention explores profoundly into the treasure of art creation and peeks in the splendid creation world.

The invention uniquely creates an innovative knitting technique and converting a painting artwork into fashioned fine-art clothes through skillful knitting techniques and art crafts without being limited the patterns or colors, and the invention can skillfully maximize the artistic verve of the painting artwork, particularly to the patterns across the front and rear knit pieces, and the stitched position is sewed delicately without a trace. The clothes so produced is the essence of current oriental having the light, soft, warm, smooth, elastic and fine and closely woven features. The invention is definitely a fashioned fine-art knitted fabric that breaks through the epochal.

The primary objective of the present invention is to provide a method of manufacturing knitted fabrics, more particularly a method of skillfully transferring a painting artwork onto a knitted fabrics to show the artistic verve of the painting. The manufacturing method includes the steps of: inputting an original drawing into a computer for digitization; editing and designing the digitized original drawing on a knitted fabric; outputting a knitting square plot after a graphic software performs a color processing; introducing graphic file information analyzed and processed by a knitting software to a knitting machine; and operators following a lamp signal of the knitting machine and the knitting square plot to knit to shape a knit piece, so as to complete a fashioned fine-art knitted fabric.

DETAILED DESCRIPTION OF THE PREFERRED EMBODIMENTS

To make it easier for our examiner to understand the objectives, technical characteristics, innovative features and performance of a manufacturing method in accordance with the present invention, we use a preferred embodiment accompanied with the attached drawings for the detailed description of the present invention.

Figure 1:
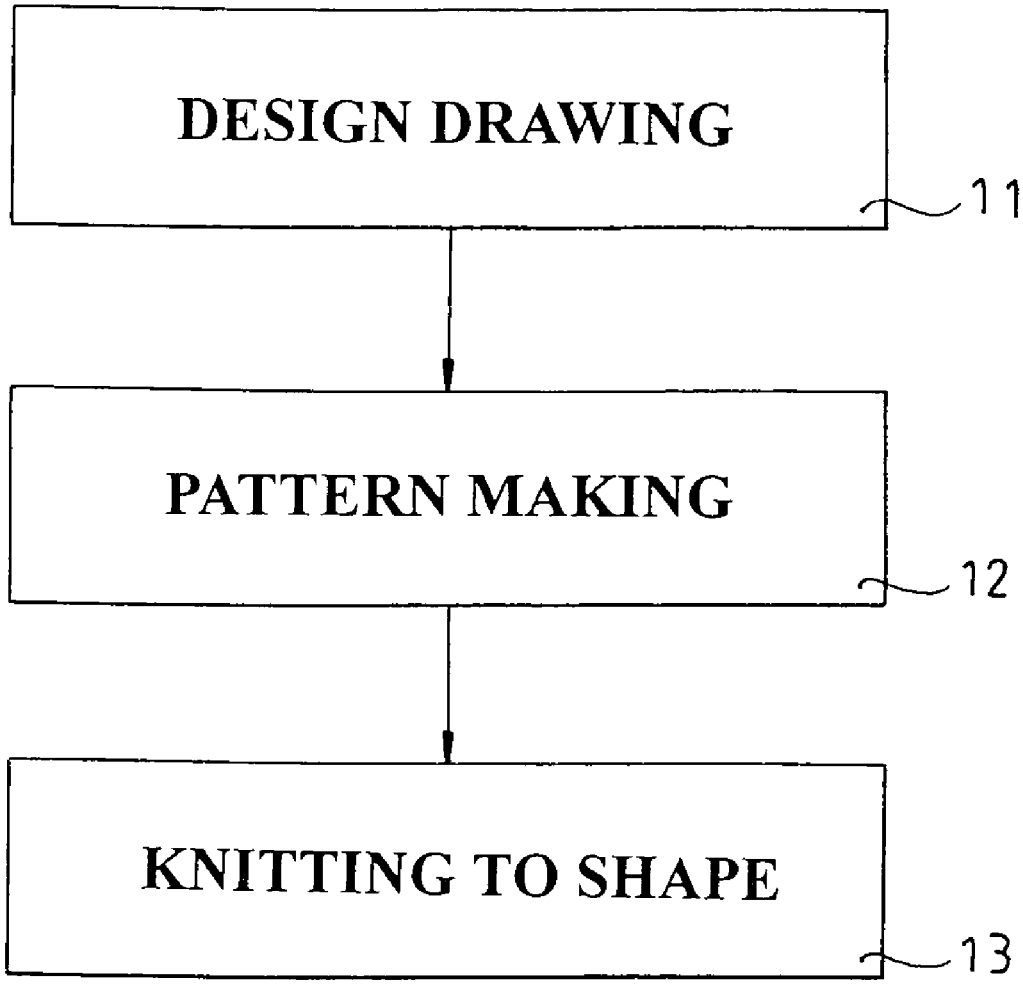
FIG. 1 (PRIOR ART)
FIG. 1 is a flow chart of a traditional knitted fabrics manufacturing method.
Figure 2:
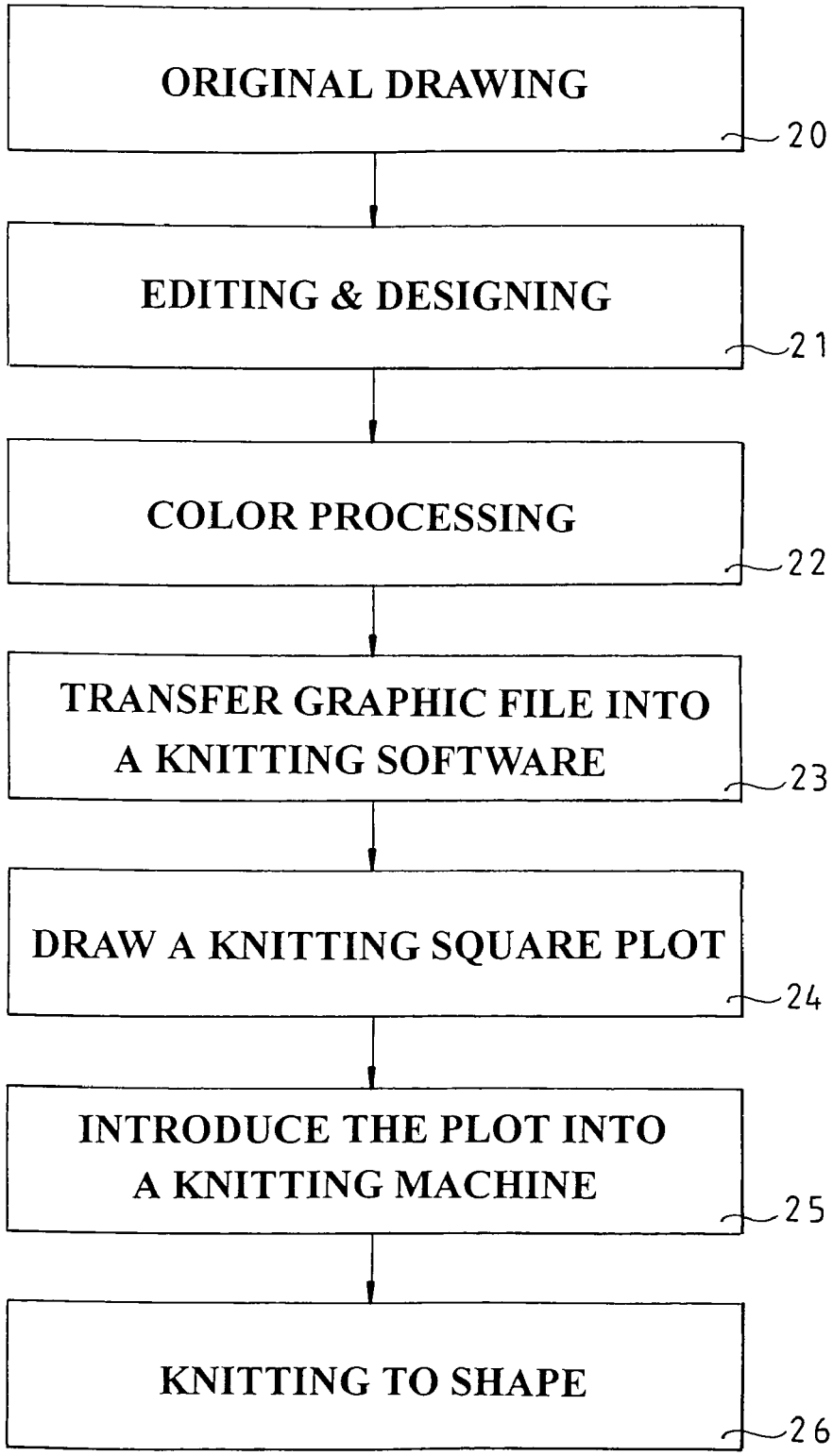
FIG. 2 is a flow chart of a method of manufacturing knitted fabrics in accordance with the present invention.

Referring to FIG. 2 for a method of manufacturing knitted fabrics in accordance with the present invention, the method comprises the steps of:

(A) Inputting an original drawing (20) into a computer for performing an image digitization process, wherein the original drawing (20) can be a simple pattern script, an antique famous painting, or even a photo can be used as a source material of the original drawing (20);

(B) Decomposing the digitized original drawing (20), and then performing an edit and design (21) for the knitted fabric, wherein the edit and design (21) process can duplicate the original drawing (20) completely or simply use a portion of the essence of the original drawing (20) for the editing and design to form a new design drawing file;

(C) Performing a color processing (22) for the new design drawing file by using a graphic software, wherein the color processing (22) makes changes to the color of the graphic file while modifying and editing the lines of the pattern and remove any black marks;

(D) Transferring the graphic file processed by the color processing (22) into a knitting software (23), and outputting a knitting square plot (24) after being analyzed and processed by the knitting software;

(E) introducing the graphic file information analyzed and processed by the knitting software to a knitting machine (25); and (F) knitting to shape (26) a knit piece according to a manufacture process performed by the knitting machine, wherein the graphic file information introduced by the knitting software is indicated by a lamp signal, and a knitting square plot (24) is outputted.

With the aforementioned manufacturing method, the artistic verve of the painting artwork can be maximized skillfully to show the essence of a fashioned fine-art knitted fabric of oriental arts.

Figure 3:
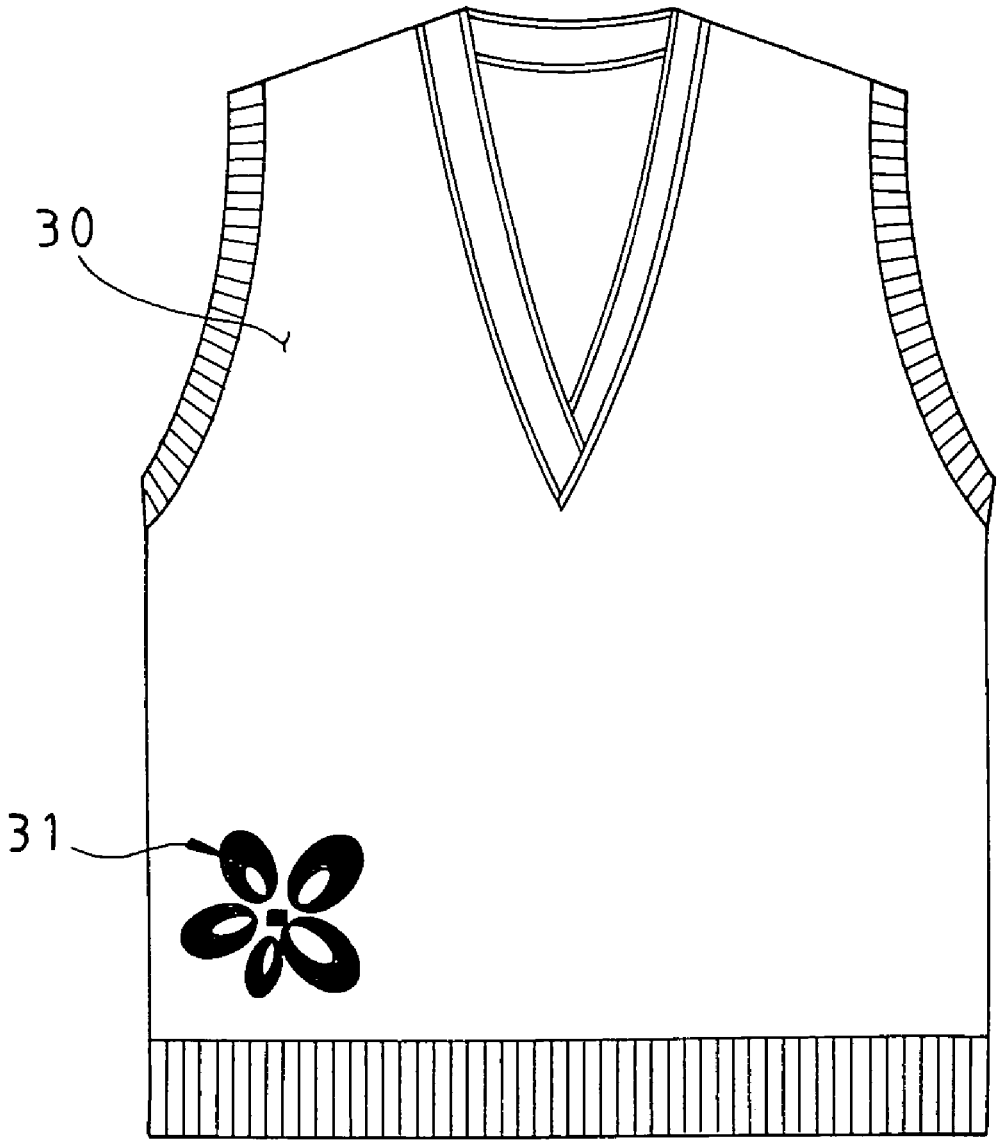
FIG. 3 is a schematic view of a knitted product of the present invention.

Referring to FIG. 3 for a clear description of the technique of the present invention, the knitted product (30) is a wool vest, and a pattern (31) is designed on a side at the bottom of a front knit piece of the wool vest.

Figure 4:
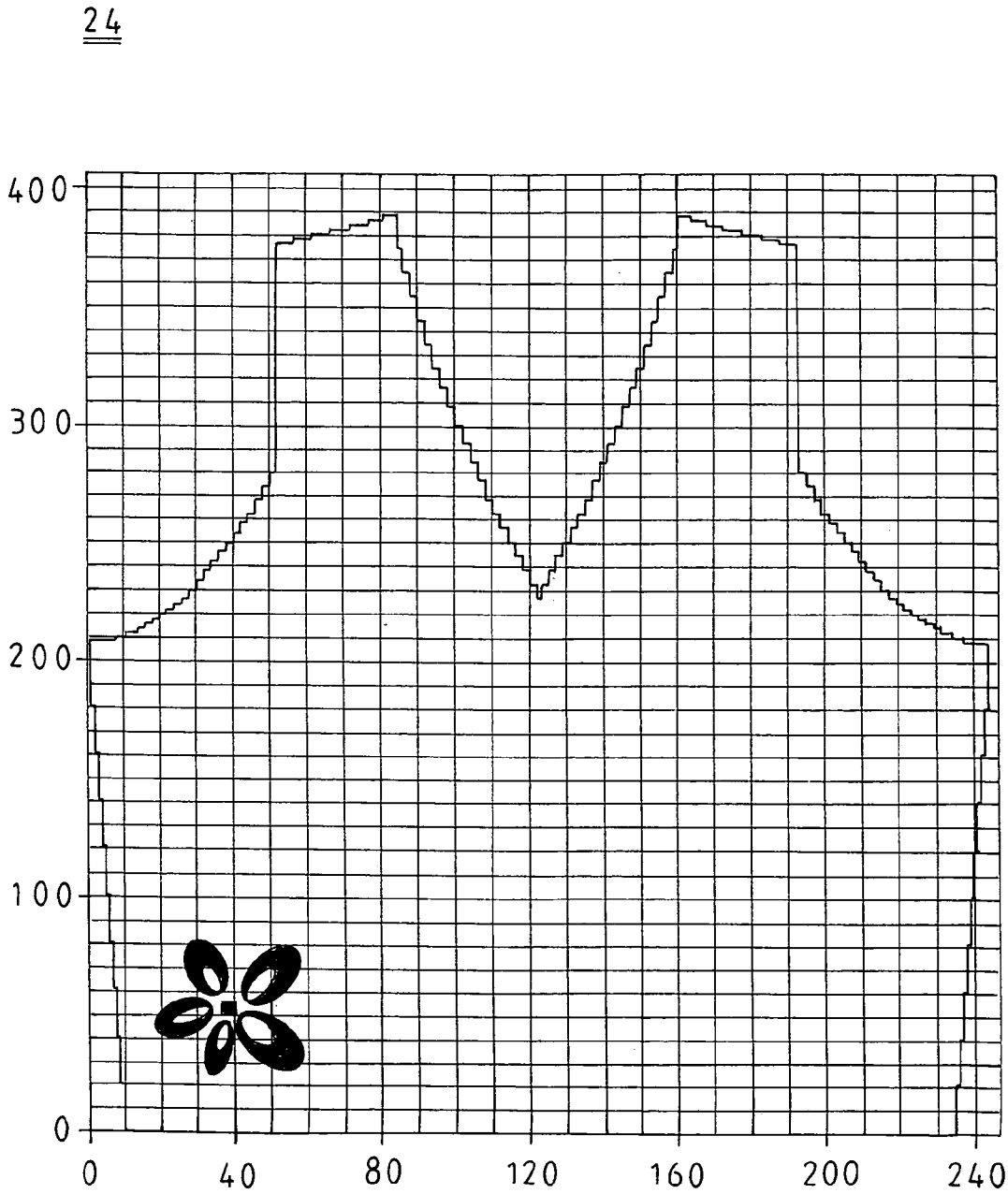
FIG. 4 is a knitting square plot of the present invention.

In the method of manufacturing knitted fabrics of the invention, an original drawing which is a flower pattern as shown in FIG. 3 is inputted into a computer for an image digitization process, and then the original drawing is edited and redesigned on the knitted fabric, and a color processing is performed on the design drawing file by a graphic software, and the graphic file after being processed by the color processing is transferred into a knitting software, and a knitting square plot is outputted. FIG. 4 shows the knitting square plot (24) of the front knit piece of the wool vest, and the knitting square represents the corresponding positions of the warp and welt of the yarn, and the figure shows a 250×410 knitting square plot.

Figure 5:
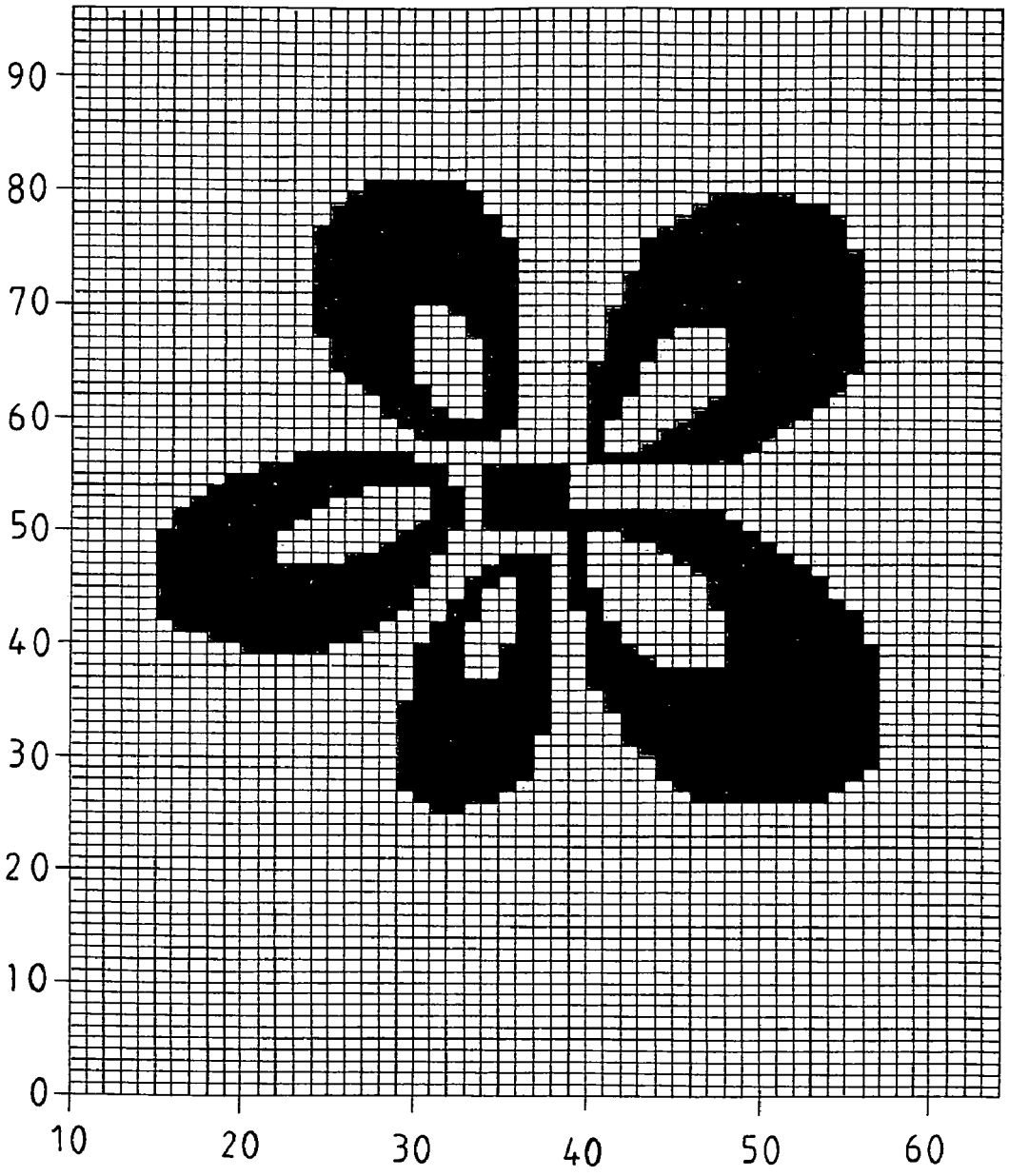
FIG. 5 is an enlarged view of a portion of a knitting square plot of the present invention.

FIG. 5 shows an enlarged view of a portion of a knitting square plot of the present invention, each square in the knitting square plot represents the position of a corresponding yarn, and the color of each knitting square is analyzed and processed, and then a complete knitting square plot is produced according to the basic color arrangement and the sequence of stitches of the yarn. The graphic file information analyzed and processed by the knitting software is introduced to a knitting machine. Operators follow the lamp indication of the knitting machine as well as the knitting square plot to knit to shape the knit piece.

In the method of manufacturing knitted fabrics in accordance with the present invention, an embodiment of producing and shaping a simple flower pattern on the aforementioned wool vest is used for illustrating the objective and effect of the present invention. With this method of manufacturing knitted fabrics, any complicated original drawing including the Western's oil paintings, the Oriental's natural scenery and birds and beasts can be converted into a color knitting square plot, and the color knitting square plot can be used for stitching out a fine and closely woven fashioned fine-art knitted fabric.

Further, the manufacturing technology of the invention can correspond each knitting square precisely, and the adopted color of the yarn can fully and skillfully express the artistic verve of the original drawing of the artwork. Particularly, when the patterns and lines of the original drawing are duplicated onto the position between front and rear knit pieces of a cloth, the stitched position between the front and rear knit pieces is sewed up delicately to show the excellence of art craft technique.

While the invention is described in some detail with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

In summation of the description above, the invention is in compliance with the requirements of patent application, and is thus duly filed for a patent application.

What is claimed is:

1. A method of manufacturing knitted fabrics, comprising the steps of:

(A) inputting an original drawing into a computer for performing an image digitization process;

(B) decomposing the digitized original drawing, and editing and designing the digitized original drawing for a knitting fabric to form a new design drawing file;

(C) performing a color processing of the new design drawing file by a graphic software, wherein the processing removes any extraneous black marks and outputs a graphic file;

(D) transferring the processed graphic file into a knitting software, and outputting a knitting square graph after the graphic file is analyzed and processed by the knitting software;

(E) introducing the knitting square graph to a hand flat knitting machine; and (F) utilizing a hand flat knitting machine to shape a knit piece, wherein the graphic file information introduced by the knitting software is displayed by a lamp signal together with the knitting square graph to indicate to an operator to hang a corresponding color yarn onto a position of a corresponding crochet hook.

* * * * *